US008080352B2

(12) United States Patent
Moffat

(10) Patent No.: US 8,080,352 B2
(45) Date of Patent: Dec. 20, 2011

(54) GRAFTING METAL OXIDES ONTO POLYMER FOR TONER

(75) Inventor: Karen A. Moffat, Brantford (CA)

(73) Assignee: Xerox Corporation, Norwalk, CT (US)

( * ) Notice: Subject to any disclaimer, the term of this patent is extended or adjusted under 35 U.S.C. 154(b) by 1111 days.

(21) Appl. No.: 11/867,250

(22) Filed: Oct. 4, 2007

(65) Prior Publication Data

US 2009/0092918 A1 Apr. 9, 2009

(51) Int. Cl.
*G03G 9/087* (2006.01)

(52) U.S. Cl. ..... 430/108.6; 430/108.7; 430/109.4; 430/110.2; 430/137.11; 430/137.14

(58) Field of Classification Search ..... 430/108.6, 430/108.7, 110.2, 109.4, 137.14, 137.11
See application file for complete search history.

(56) References Cited

U.S. PATENT DOCUMENTS

| | | | | |
|---|---|---|---|---|
| 4,734,350 | A * | 3/1988 | Lin et al. | 430/108.2 |
| 5,055,497 | A * | 10/1991 | Okada et al. | 523/116 |
| 5,843,525 | A * | 12/1998 | Shibasaki et al. | 427/214 |
| 2006/0216628 | A1 * | 9/2006 | Nakamura et al. | 430/110.2 |

FOREIGN PATENT DOCUMENTS

JP 2005-082765 * 3/2005

OTHER PUBLICATIONS

Japanese Patent Office machine-assisted translation of JP 2005-082795 (pub. Mar. 2005).*
Anna Finne et al., "New Functionalized Polyesters to Achieve Controlled Architectures", Journal of Polymer Science: Part A: Polymer Chemistry, 2004, vol. 42, pp. 444-452.
Jarkko J. Heikkinen et al., "Grafting of Functionalized Silica Particles with Poly(acrylic acid)", Polymers for Advanced Technologies, 2006, vol. 17, pp. 426-429.
Werner Stöber et al., "Controlled Growth of Monodisperse Silica Spheres in the Micron Size Range", Journal of Colloid and Interface Science, 1968, vol. 26, pp. 62-69.
Elodie Bourgeat-Lami et al., "Nucleation of Polystyrene Latex Particles in the Presence of γ-Methacryloxypropyl-trimethoxysilane: Functionalized Silica Particles", Journal of Nanoscience and Nanotechnology, 2006, vol. 6, pp. 432-444.
Canadian Office Action mailed Mar. 25, 2011, issued in Canadian Patent Application No. 2,639,951.

* cited by examiner

*Primary Examiner* — Janis L Dote
(74) *Attorney, Agent, or Firm* — Oliff & Berridge, PLC

(57) ABSTRACT

Toner particles, including at least one binder, at least one colorant, and at least one metal oxide surface additive, wherein the at least one metal oxide surface additive is a metal oxide particle covalently bonded with at least one polycondensation polymer.

17 Claims, No Drawings

GRAFTING METAL OXIDES ONTO POLYMER FOR TONER

BACKGROUND

Described herein are toners, and developers containing the toners, in particular emulsion aggregation toners, with improved stability of triboelectric charging performance. In particular, the present disclosure is related to methods of grafting metal oxide particles onto polycondensation polymer such as polyester resin. The resin with the covalently linked metal oxide particles can be used as a material for forming an outer surface, or shell, of a toner particle.

Emulsion aggregation (EA) toners are excellent toners to use in forming print and/or xerographic images in that the toners can be made to have uniform sizes and in that the toners are environmentally friendly. Common types of EA toners include polyester based and acrylate based toner.

EA techniques typically involve the formation of an emulsion latex of the resin particles, which particles have a small size of from, for example, about 3 to about 500 nanometers in diameter, by heating the resin, optionally with solvent if needed, in water, or by making a latex in water using emulsion polymerization. A colorant dispersion, for example of a pigment dispersed in water, optionally also with additional resin, is separately formed. The colorant dispersion is added to the emulsion latex mixture, and aggregation is conducted, for example with addition of an aggregating agent or complexing agent, to form aggregated toner particles. The aggregated toner particles are optionally heated to enable coalescence/fusing, thereby achieving aggregated, fused toner particles.

External surface additives are typically added to the surface of the toner particle. Such surface additives include, for example, metal oxides such as silica, which is applied to the toner surface for toner flow, triboelectric enhancement, admix control, improved development and transfer stability and higher toner blocking temperature, and titania, which is applied for improved relative humidity (RH) stability, triboelectric control and improved development and transfer stability.

Toner charging performance may be negatively affected by poor surface additive attachment to a toner particle surface, which can lead to contamination of loose additives as dirt in a machine. Currently, processes to improve surface additive attachment adjust the additive blending conditions in an effort to improve the physical attachment.

Toner charging performance may also be negatively affected by additive impaction, which is observed when toner ages in a development housing, impacting developer flow, and charging, along with cleaning and transfer. Currently, processes to improve additive impaction include redesign of the toner resin for either conventional or EA toners to increase the polymer glass transition temperature (Tg) to produce a tougher, more durable particle surface.

SUMMARY

In embodiments, described are toner particles including a binder, at least one colorant, and at least one metal oxide surface additive, wherein the at least one metal oxide surface additive is a metal oxide particle covalently bonded with at least one polycondensation polymer.

In further embodiments, described is a method of making toner particles, including aggregating an emulsion comprised of a polymer binder and at least one colorant to form cores, introducing an emulsion of shell material following formation of the cores, and continuing aggregation to form shells of the shell material on the cores, and thereafter ceasing aggregation and recovering core-shell toner particles, wherein the shell material comprises at least one metal oxide surface additive comprised of a metal oxide particle covalently bonded with at least one polycondensation polymer.

EMBODIMENTS

Functionalized metal oxide particles are grafted (covalently bonded) with polycondensation polymers, such as polyesters, via covalent bonds at the functionalized sites. The covalently bonded metal oxide particles and polymer are incorporated as a component in an emulsion aggregation (EA) toner formation process, in particular as a compound in the shell formation step. This use in EA toner prevents the metal oxide particles from coming off or becoming overly embedded in the particle surface, which thus improves triboelectric charge stability.

A method for improving the stability of the triboelectric charging performance of EA toner may thus be achieved by designing and preparing surface functionalized metal oxide particles, such as silicon dioxide ($SiO_2$) or titanium dioxide ($TiO_2$), followed by grafting the functionalized metal oxides onto a polycondensation polymer such as polyester containing a vinyl group in the polyester resin which comes from the incorporation of for example, fumeric acid. While the methods disclosed herein use silicon dioxide ($SiO_2$) and titanium dioxide ($TiO_2$) as examples, one of ordinary skill in the art will appreciate that other metal oxides are well within the scope of the present disclosure.

The toner particles described herein are comprised of polymer binder, at least one colorant and one or more metal oxide surface additives. A wax may also be included in the toner particles.

In embodiments, the binder includes a polycondensation polymer such as a polyester. For ultra low melt applications, the binder may comprise a mixture of crystalline (including semi-crystalline) and amorphous polycondensation polymers, the crystalline polymers lowering the melting temperature of the toner.

Examples of suitable polymer binders that may be used include polyesters, polyamides, polyimides, polyketones, or polyolefin resins.

Illustrative examples of crystalline polyesters include any of various polyesters, such as poly(ethylene-adipate), poly(propylene-adipate), poly(butylene-adipate), poly(pentylene-adipate), poly(hexylene-adipate), poly(octylene-adipate), poly(nonylene-adipate), poly(decylene-adipate), poly(undecylene-adipate), poly(dodecylene-adipate), poly(ethylene-glutarate), poly(propylene-glutarate), poly(butylene-glutarate), poly(pentylene-glutarate), poly(hexylene-glutarate), poly(octylene-glutarate), poly(nonylene-glutarate), poly(decylene-glutarate), poly(undecylene-glutarate), poly(dodecylene-glutarate), poly(ethylene-succinate), polypropylene-succinate), poly(butylene-succinate), poly(pentylene-succinate), poly(hexylene-succinate), poly(octylene-succinate), poly(nonylene-succinate), poly(decylene-succinate), poly(undecylene-succinate), poly(dodecylene-succinate), poly(ethylene-pimelate), poly(propylene-pimelate), poly(butylene-pimelate), poly(pentylene-pimelate), poly(hexylene-pimelate), poly(octylene-pimelate), poly(nonylene-pimelate), poly(decylene-pimelate), poly(undecylene-pimelate), poly(dodecylene-pimelate), poly(ethylene-sebacate), poly(propylene-sebacate), poly(butylene-sebacate), poly(pentylene-sebacate), poly(hexylene-sebacate), poly(octylene-sebacate), poly (nonylene-sebacate), poly(decylene-sebacate), poly (undecylene-sebacate), poly(dodecylene-sebacate), poly (ethylene-azelate), poly(propylene-azelate), poly(butylene-azelate), poly(pentylene-azelate), poly(hexylene-azelate), poly(octylene-azelate), poly(nonylene-azelate), poly(decylene-azelate), poly(undecylene-azelate), poly(dodecylene-azelate), poly(ethylene-dodecanoate), poly(propylene-dodecanoate), poly(butylene-dodecanoate), poly(pentylene-dodecanoate), poly(hexylene-dodecanoate), poly(octylene-dodecanoate), poly(nonylene-dodecanoate), poly(decylene-dodecanoate), poly(undecylene-dodecanoate), poly (dodecylene-dodecanoate), poly(ethylene-fumarate), polypropylene-fumarate), poly(butylene-fumarate), poly (pentylene-fumarate), poly(hexylene-fumarate), poly(octylene-fumarate), poly(nonylene-fumarate), poly(decylene-fumarate), poly(undecylene-fumarate), poly(dodecylene-fumarate), copoly-(butylene-fumarate)-copoly-(hexylene-fumarate), copoly-(ethylene-dodecanoate)-copoly-(ethylene-fumarate), mixtures thereof, and the like.

Other examples of crystalline materials include polyolefins, such as polyethylene, polypropylene, polypentene, polydecene, polydodecene, polytetradecene, polyhexadecene, polyoctadene, and polycyclodecene, polyolefin copolymers, mixtures of polyolefins, bi-modal molecular weight polyolefins, functional polyolefins, acidic polyolefins, hydroxyl polyolefins, branched polyolefins, for example, such as those available from Sanyo Chemicals of Japan as VISCOL 550P™ and VISCOL 660P™, Mitsui "Hi-wax" NP055 and NP105, or wax blends such as MICROPOWDERS, Micropro-440 and 440w. In embodiments, the crystalline polyolefin may be maleated olefins, such as CERAMER (Baker Hughes).

The crystalline resin can possess a melting point of, for example, from at least about 60° C., or for example, from about 70° C. to about 80° C., and a number average molecular weight ($M_n$), as measured by gel permeation chromatography (GPC) of, for example, from about 1,000 to about 50,000, or from about 2,000 to about 25,000, with a weight average molecular weight ($M_w$) of, for example, from about 2,000 to about 100,000, or from about 3,000 to about 80,000, as determined by GPC using polystyrene standards. The molecular weight distribution ($M_w/M_n$) of the crystalline resin is, for example, from about 2 to about 6, and more specifically, from about 2 to about 4.

In embodiments, suitable amorphous resins that may be used include linear amorphous resins or branched amorphous resins.

Illustrative examples of amorphous polyesters include, for example poly(1,2-propylene-diethylene)terephthalate, polyethylene-terephthalate, polypropylene-terephthalate, polybutylene-terephthalate, polypentylene-terephthalate, polyhexylene-terephthalate, polyheptadene-terephthalate, polyoctalene-terephthalate, polyethylene-sebacate, polypropylene-sebacate, polybutylene-sebacate, polyethylene-adipate, polypropylene-adipate, polybutylene-adipate, polypentylene-adipate, polyhexylene-adipate polyheptadene-adipate, polyoctalene-adipate, polyethylene-glutarate, polypropylene-glutarate, polybutylene-glutarate, polypentylene-glutarate, polyhexylene-glutarate, polyheptadene-glutarate, polyoctalene-glutarate, polyethylene-pimelate, polypropylene-pimelate, polybutylene-pimelate, polypentylene-pimelate, polyhexylene-pimelate, polyheptadene-pimelate, poly(propoxylated bisphenol co-fumarate), poly (ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly (ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly (ethoxylated bisphenol co-itaconate), poly(butyloxylated bisphenol co-itaconate), poly(co-propoxylated bisphenol co-ethoxylated bisphenol co-itaconate), or poly(1,2-propylene itaconate). The amorphous polyester resin may also be crosslinked or branched to, for example, assist in the achievement of a broad fusing latitude, or when black or matte prints are desired.

Other examples of amorphous resins that may be utilized herein include poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly (styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylononitrile-acrylic acid), poly(styrene-butadiene-.beta.-carboxyethyl acrylate), poly(styrene-butadiene-acrylonitrile-.beta.-carboxyethyl acrylate), polystyrene-butyl acrylate-.beta.-carboxyethyl acrylate), and poly(styrene-butyl acrylate-acrylononitrile-.beta.-carboxyethyl acrylate). Such an amorphous resin may possess a weight average molecular weight ($M_w$) of, for example, from about 20,000 to about 55,000, and more specifically, from about 25,000 to about 45,000, a number average molecular weight ($M_n$) of, for example, from about 5,000 to about 18,000, and more specifically, from about 6,000 to about 15,000.

The amorphous resin may be, for example, present in an amount of from about 50 to about 90 percent by weight, and, for example, from about 65 to about 85 percent by weight of the toner, which resin may be a branched or linear amorphous polyester resin where amorphous resin can possess, for example, a number average molecular weight ($M_n$), as measured by gel permeation chromatography (GPC), of from about 5,000 to about 500,000, and more specifically, for example, from about 5,000 to about 250,000, a weight average molecular weight ($M_w$) of, for example, from about 7,000 to about 600,000, and more specifically, for example, from about 7,000 to about 300,000, as determined by GPC using polystyrene standards; and wherein the molecular weight distribution ($M_w/M_n$) is, for example, from about 1.5 to about 6, and more specifically, from about 2 to about 4. Crystalline polymer, when present, may be included with the amorphous polymer in amounts of from about 1 to about 50% by weight, such as from about 2 to about 30% by weight, of the binder.

Mixtures of two or more of the above polymers may also be used, if desired.

The crystalline resin may be a polymer that may be the same as, similar to or different than a polymer of the amorphous resin. In embodiments, the crystalline resin and the amorphous resin are both polyester resins.

In embodiments, the polymer binder is formed into a latex emulsion by any suitable method, for example by formation of the polymer from suitable monomers in an aqueous solution to form small sized polymer particles, for example on the order of about 5 nm to about 500 nm. The polymer may be formed into a latex emulsion with or without the use of suitable surfactants, as necessary. Of course, any other suitable method for forming an emulsion of the polymer particles may be used without restriction.

In embodiments, the toner herein has a core-shell structure. In such embodiments, the core may comprise amorphous polymer alone, or may comprise a mixture of crystalline and amorphous polymers, while the shell is desirably free of crystalline polymer and is thus comprised of only amorphous polymer. The core is comprised of toner particle materials, including at least the binder and the colorant. Once the core particle is formed by aggregation to a desired size, a thin outer shell is then formed upon the core particle. Such may be achieved by, for example, addition of emulsion comprised of shell materials to the aggregated core particles, and continuing aggregation to form the shell on the aggregated core. The shell may be comprised of only binder material, although other components may be included therein if desired. Desirably, the shell material also includes the metal oxide particle surface additives covalently bonded with polymer.

In embodiments, the total amount of binder, including core and shell if present, is in an amount of from about 60 to about 95% by weight of the toner particles (that is, the toner particles exclusive of external additives) on a solids basis, such as from about 70 to about 90% by weight of the toner.

Various suitable colorants may be employed, including suitable pigments, dyes, mixtures of pigments, mixtures of dyes, and mixtures of pigments and dyes. Suitable examples include, for example, carbon black such as REGAL 330 carbon black, acetylene black, lamp black, aniline black, Chrome Yellow, Zinc Yellow, SICOFAST Yellow, SUNBRITE Yellow, LUNA Yellow, NOVAPERM Yellow, Chrome Orange, BAYPLAST Orange, Cadmium Red, LITHOL Scarlet, HOSTAPERM Red, FANAL PINK, HOSTAPERM Pink, LUPRETON Pink, LITHOL Red, RHODAMINE Lake B, Brilliant Carmine, HELIOGEN Blue, HOSTAPERM Blue, NEOPAN Blue, PV Fast Blue, CINQUASSI Green, HOSTAPERM Green, titanium dioxide, cobalt, nickel, iron powder, SICOPUR 4068 FF, and iron oxides such as MAPICO Black (Columbia) NP608 and NP604 (Northern Pigment), BAYFERROX 8610 (Bayer), M08699 (Mobay), TMB-100 (Magnox), mixtures thereof and the like.

The colorant, such as black, cyan, magenta and/or yellow colorant, is incorporated in an amount sufficient to impart the desired color to the toner. In general, colorant is employed in an amount ranging from about 2% to about 35% by weight of the toner particles on a solids basis, such as from about 4% to about 25% by weight or from about 4% to about 15% by weight of the toner particles on a solids basis. Of course, as the colorants for each color are different, the amount of colorant present in each type of color toner may be different.

In embodiments, in addition to the binder and the colorant, the toners may also contain a wax dispersion. The wax is added to the toner formulation in order to aid toner offset resistance, for example, toner release from the fuser roll, particularly in low oil or oil-less fuser designs. For emulsion aggregation (EA) toners, for example ultra low melt polyester EA toners, linear polyethylene waxes such as the POLYWAX® line of waxes available from Baker Petrolite are useful. Of course, the wax dispersion may also comprise polypropylene waxes, other waxes known in the art, and mixtures of waxes.

To incorporate the wax into the toner, the wax may be in the form of an aqueous emulsion or dispersion of solid wax in water, where the solid wax particle size is usually in the range of from about 100 to about 500 nm.

The toners may contain from, for example, about 5 to about 20% by weight of the toner, on a solids basis, of the wax. In embodiments, the toners contain from about 8 to about 15% by weight of the wax.

The toners may also optionally contain other additives such as a coagulant and/or a flow agent such as colloidal silica. The flow agent, if present, may be any colloidal silica such as SNOWTEX OL/OS brand colloidal silica. The colloidal silica is present in the toner particles, exclusive of external additives and on a dry weight basis, in amounts of from 0 to about 15% by weight of the toner particles, such as from about greater than 0 to about 10% by weight of the toner particles.

The toner may also include additional known positive or negative charge additives in effective suitable amounts of, for example, from about 0.1 to about 5 weight percent of the toner, such as quaternary ammonium compounds inclusive of alkyl pyridinium halides, bisulfates, organic sulfate, sulfonate compositions, cetyl pyridinium tetrafluoroborates, distearyl dimethyl ammonium methyl sulfate, aluminum salts or complexes, and the like.

In embodiments, the toner particles have an average particle size of from about 1 to about 15 μm, such as from about 3 to about 12 μm. The particle size may be determined using any suitable device, for example a conventional COULTER COUNTER®. The circularity may be determined using the known Malvern Sysmex Flow Particle Image Analyzer FPIA-2100.

In preparing the toner by the EA procedure, one or more surfactants may be used in the process. Suitable surfactants include anionic, cationic and nonionic surfactants.

Anionic surfactants include sodium dodecylsulfate (SDS), sodium dodecyl benzene sultanate, sodium dodecylnaphthalene sulfate, dialkyl benzenealkyl, sulfates and sulfonates, abitic acid, the DOWFAX brand of anionic surfactants, and the NEOGEN brand of anionic surfactants. An example of an anionic surfactant is NEOGEN RK available from Daiichi Kogyo Seiyaku Co. Ltd., which consists primarily of branched sodium dodecyl benzene sulphonate.

Examples of cationic surfactants include dialkyl benzene alkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecyl benzyl triethyl ammonium chloride, MIRAPOL and ALKAQUAT available from Alkaril Chemical Company, SANISOL (benzalkonium chloride), available from Kao Chemicals, and the like. An example of a cationic surfactant is SANISOL B-50 available from Kao Corp., which consists primarily of benzyl dimethyl alkonium chloride.

Examples of nonionic surfactants include polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc Inc. as IGEPAL CA-210, IGEPAL CA-520, IGEPAL CA-720, IGEPAL CO-890, IGEPAL CO-720, IGEPAL CO-290, IGEPAL CA-210, ANTAROX 890 and ANTAROX 897. An example of a nonionic surfactant is ANTAROX 897 available from Rhone-Poulenc Inc., which consists primarily of alkyl phenol ethoxylate.

In embodiments, an EA procedure may be used in forming EA toner particles. EA procedures typically include the basic process steps of at least aggregating a latex emulsion containing binder(s), the optional one or more colorants, the optional one or more surfactants, the optional wax emulsion, an optional coagulant and one or more additional optional additives to form aggregates, forming a shell on the aggregated core particles, subsequently optionally coalescing or fusing the aggregates, and then recovering, optionally washing and optionally drying the obtained EA toner particles.

Suitable optional coagulants that may be employed include any coagulant known or used in the art, including the well known coagulants polyaluminum chloride (PAC) and/or polyaluminum sulfosilicate (PASS) and/or aluminum sulphate or other multivalent cationic salt materials. In embodiments, the coagulant is poly(aluminum chloride) and or aluminum sulphate. The coagulant may be used in amount of from about 0 to about 5% by weight of the toner particles, such as from about greater than 0 to about 3% by weight of the toner particles.

An exemplary EA process includes forming a mixture of latex binder, colorant dispersion, optional wax emulsion, optional coagulant and deionized water in a vessel. The mixture is stirred using a homogenizer until homogenized and then transferred to a reactor where the homogenized mixture is heated to a temperature of, for example, at least about 45° C. and held at such temperature for a period of time to permit aggregation of toner particles to a desired size. Additional latex binder is then added to form a shell upon the aggregated core particles. Once the desired size of aggregated core-shell toner particles is achieved, the pH of the mixture is adjusted in order to inhibit further toner aggregation. The toner particles are further heated to a temperature of, for example, at least about 90° C., and the pH lowered in order to enable the particles to coalesce and spherodize. The heater is then turned off and the reactor mixture allowed to cool to room temperature, at which point the aggregated and coalesced toner particles are recovered and optionally washed and dried.

The shell latex may be added to the toner aggregates in an amount of about 5 to about 40 percent by weight of the total binder materials, particularly in an amount of about 5 to about 30 percent by weight of the total binder materials. In embodiments, the shell or coating on the toner aggregates has a thickness of about 0.2 to about 1.5 μm, such as from about 0.5 to about 1.0 μm.

In embodiments, following coalescence and aggregation, the particles are wet sieved through an orifice of a desired size in order to remove particles of too large a size, washed and treated to a desired pH, and then dried to a moisture content of, for example, less than 1% by weight.

In embodiments, a method may be used to design and prepare surface functionalized metal oxide particles, such as silicon dioxide ($SiO_2$) or titanium dioxide ($TiO_2$) nanoparticles, followed by grafting the functionalized metal oxides onto polycondensation polymers such as polyester resins. These polymer/metal oxide composites may then be incorporated as a component of the shell material in core-shell toners. The shell material may also contain additional binder material, such as amorphous polymers. The weight percent of amorphous resin added as the shell component of the particle ranges, for example, from about 15 weight percent to about 35 weight percent, such as from about 20 weight percent to about 30 weight percent. The weight percent of metal oxide based on the amount of shell amorphous resin may be from about 0.5 weight percent to about 30 weight percent.

In embodiments, the metal oxides for use in forming the polymer/metal oxide composite include, for example, one or more of silicon dioxide ($SiO_2$), titanium dioxide ($TiO_2$) and aluminum oxide. In general, silica is applied to the toner surface for toner flow, tribo enhancement, admix control, improved development and transfer stability and higher toner blocking temperature. ($TiO_2$) is applied for improved relative humidity (RH) stability, tribo-electric control and improved development and transfer stability.

Thus, to improve tribo-electric charging performance of, for example, EA toners, surface functionalized metal oxides, such as silicon dioxide and titanium dioxide, may be prepared, followed by grafting the functionalized metal oxides onto a polycondensation polymer, such as polyester resin, with the grafted metal oxides incorporated into the shell of the EA toner.

In embodiments, the toners may contain polymer/metal oxide components in an amount of from, for example, about 0.5 to about 15 weight percent, such as from about 1 to about 10 weight percent, of the toner particles.

In embodiments, the metal oxide particles are nanosized metal oxide particles that range in size from about 10 to about 500 nm, for example, from about 10 nm to about 400 nm, with non-spacer metal oxide particles desirably having a size of from about 10 to about 50 nm. In embodiments, the spacer metal oxide particles are large nanosized (for example, about 100 nm to about 400 nm) particles.

Although several different methods to functionalize metal oxide surfaces are within the scope of the present disclosure, in embodiments, potential functional groups, such as an amine, a hydroxyl, an epoxide, or a carboxylic acid on a polyester chain may be implemented provided that during post polymer functionalization, the polymer chains are not degraded, thus reducing the chain length. In further embodiments, various reagents may be used to functionalize the surface of a metal oxide, whereby upon addition of two components (as shown in Example 1, below), the metal oxides become attached to the polyester resin. This, in turn, will result in an exposed amine or epoxy functional groups available for further reaction such as, for example, grafting of 3-aminopropyl-functionalized silica particles or 3-glycidoxypropyl-functionalized silica particles onto poly(acrylic acid). Silica particles may be modified with a silane coupling agent such as γ-methacryloxypropyl-trimethoxysilane containing a vinyl end group that is subsequently co-polymerized with styrene by emulsion polymerization to generate silica/polystyrene nanocomposite particles.

In embodiments, the binder of the shell is an amorphous polyester, and the chain grafted to the functionalized metal oxide is also a polyester. The chemistry of the polyester chain grafting to the metal oxide should be compatible in design to the amorphous polyester resins used in the design of ultra low melt polyester toners so that during the aggregation and coalescence process, the polyester chains of the particles will coalesce, providing a smooth particle surface free of surface pin-holes with a nano-structured surface morphology due to the metal oxides. If polymers other than polyester are used, the above compatibility requirement desirably is still met. Because the metal oxide particles are distributed as pendant moieties along the polymer chain in a controlled manner, the silicon dioxide ($SiO_2$) or titanium dioxide ($TiO_2$) particles are prevented from being removed from the toner particle surface during the xerographic process.

The surface functionalized metal oxide particles are then covalently bonded to a polycondensation polymer by any suitable reaction. Any of the aforementioned crystalline and amorphous polymers may be used as the polycondensation polymer to be grafted to the metal oxides. The polymer chain may be appropriately functionalized in any known manner to provide a reactive site with the functionalized sites on the metal oxide surface. For example, where the metal oxide is functionalized with amine groups the polymer chain may be functionalized with epoxide groups. Two examples of functionalized pairs are amines reacted with epoxides (that is, functionalize with the amine to graft with the epoxy group) and epoxides reacted with carboxylic acids (that is, functionalize with the epoxy group and graft with the carboxylic acid). An exemplary process to functionalize a polymer chain is provide in "Step 1" (below).

An example of a process for grafting polycondensation polymer to functionalized surface metal oxides is as follows:

A step of performing epoxidation in a solvent, such as dichloromethane, with 2 equivalents of meta-chloroperoxybenzoic acid (mCPBA) based on a content of unsaturated units in a polyester resin. This reaction may be conducted under stirring at room temperature or slightly elevated temperatures up to 50° C. until a double-bond conversion is complete. After the reaction is complete, the polymer is precipitated in cold hexane to obtain an epoxidized polymer.

A step of: functionalizing a silica particle surface with an amine functional group may be achieved by preparing sol-gel silica nanoparticles by cocondensation directly in the presence of an amine containing component. For example, tetraethoxysilane (TEOS) or tetramethoxysilane (TMOS) is mixed with either (3-aminopropyl)trimethoxylsilane or (3-aminopropyl)triethyloxysilane in a molar ratio of 0.85 to 0.15 with appropriate amounts of ethanol (or methanol), water and ammonia to prepare the amine containing component. The solution is then stirred for a period of time of about 2 to about 10 hours at room temperature.

A step of coupling the amine functionalized silica particles to the epoxidized polyester resin. The epoxidized resin is dissolved in an appropriate solvent such as dimethylformamide and a solution is bubbled with nitrogen to produce an inert atmosphere to which is added the amine functionalized silica particles. The mixture is then stirred for about 24 hours at an elevated temperature of about 70° C. After cooling the mixture to room temperature, the grafted polymer is filtered and washed to remove organic impurities and unreacted silica and polymer.

The toner particles may be blended with additional external additives following formation. Any suitable surface additives may be used such as, for example, a metal salt of a fatty acid (for example, zinc stearate (ZnSt), calcium stearate) or long chain alcohols such as UNILIN 700. Zinc stearate provides developer conductivity and tribo enhancement, both due to its lubricating nature. In addition, zinc stearate enables higher toner charge and charge stability by increasing the number of contacts between toner and carrier particles. Calcium stearate and magnesium stearate provide similar functions. However, a commercially available zinc stearate known as Zinc Stearate L, obtained from Ferro Corporation may also be used. In embodiments, the external surface additives can be used with or without a coating.

Surface treated silicas that can be utilized as an additional surface additive include, for example, TS-530 from Cabosil Corporation, with an 8 nanometer particle size and a surface treatment of hexamethyldisilazane; NAX50 obtained from DeGussa/Nippon Aerosil Corporation, coated with HMDS; H2050EP obtained from Wacker Chemie, coated with an amino functionalized organopolysiloxane; CAB-O-SIL® fumed silicas such as for example TG-709F, TG-308F, TG-810G, TG-811F, TG-822F, TG-824F, TG-826F, TG-828F or TG-829F with a surface area from 105 to 280 $m^2/g$ obtained from Cabot Corporation; PDMS-surface treated silicas such as for example RY50, NY50, RY200, RY200S and R202, all available from Nippon Aerosil, and the like. Such conventional surface treated silicas are applied to the toner surface for toner flow, triboelectric charge enhancement, admix control, improved development and transfer stability, and higher toner blocking temperature.

Surface treated titania materials that are suitable as an additional surface additive include, for example, MT-3103 from Tayca Corp. with a 16 nanometer particle size and a surface treatment of decylsilane; SMT5103 obtained from Tayca Corporation or Degussa Chemicals and comprised of a crystalline titanium dioxide core; MT500B coated with DTMS (decyltrimethoxysilane); P-25 from Degussa Chemicals with no surface treatment; an isobutyltrimethoxysilane (i-BTMS) treated hydrophobic titania obtained from Titan Kogyo Kabushiki Kaisha (IK Inabata America Corporation, New York); and the like. Such surface treated titanias are applied to the toner surface for improved RH stability, triboelectric charge control and improved development and transfer stability. In embodiments, decyltrimethoxysilane (DTMS) treated titania may also be used.

Surface treated silicas may also be used as an additional surface additive as spacer particles. Examples of such surface treated silicas are sol-gel silicas. Examples of such sol-gel silicas include, for example, X24, a 150 nm sol-gel silica surface treated with hexamethyldisilazane, available from Shin-Etsu Chemical Co., Ltd.

The toner particles may be used as a single component developer, or may optionally be formulated into a two-component developer composition by mixing the toner particles with carrier particles. Illustrative examples of carrier particles that can be selected for mixing with the toner composition include those particles that are capable of triboelectrically obtaining a charge of opposite polarity to that of the toner particles. Accordingly, in one embodiment, the carrier particles may be selected so as to be of a positive polarity in order that the toner particles that are negatively charged will adhere to and surround the carrier particles, Illustrative examples of such carrier particles include granular zircon, granular silicon, glass, steel, nickel, iron ferrites, silicon dioxide, and the like. Additionally, there can be selected as carrier particles nickel berry, comprised of nodular carrier beads of nickel, characterized by surfaces of reoccurring recesses and protrusions thereby providing particles with a relatively large external area.

The selected carrier particles can be used with or without a coating, the coating generally being comprised of fluoropolymers, such as polyvinylidene fluoride resins, terpolymers of styrene, methyl methacrylate, and a silane, such as triethoxy silane, tetrafluoroethylenes, other known coatings and the like.

In embodiments, a carrier is a magnetite core, from about 35 to about 75 μm in size, coated with about 0.5% to about 5% by weight, more particularly about 1.5% by weight of a conductive polymer mixture comprised on methylacrylate and carbon black. Alternate carrier cores such as iron ferrite cores of about 35 to 75 micron in size, or steel cores, for example of about 50 to about 75 μm in size, may also be used.

The carrier particles can be mixed with the toner particles in various suitable combinations. The concentrations are usually about 1% to about 20% by weight of toner and about 80% to about 99% by weight of carrier. However, one skilled in the art will recognize that different toner and carrier percentages may be used to achieve a developer composition with desired characteristics.

The toners can be used in known electrostatographic or xerographic imaging methods. Thus for example, the toners or developers can be charged, for example, triboelectrically, and applied to an oppositely charged latent image on an imaging member such as a photoreceptor or ionographic receiver. The resultant toner image can then be transferred, either directly or via an intermediate transport member, to an image receiving substrate such as paper or a transparency sheet. The toner image can then be fused to the image receiving substrate by application of heat and/or pressure, for example with a heated fuser roll.

An example will now be described.

Example 1

Below is an illustrative example of an epoxy group on a polyester chain providing a reactive site for formation of a covalent bond with a primary amine as the functional group of a functionalized silicon dioxide ($SiO_2$) nanoparticle.

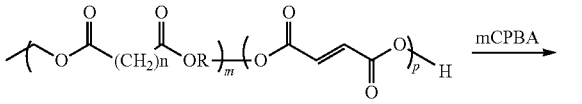

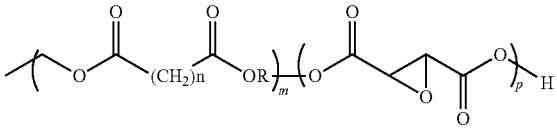

Step 2: Functionalize Surface of Metal Oxide Nanoparticles

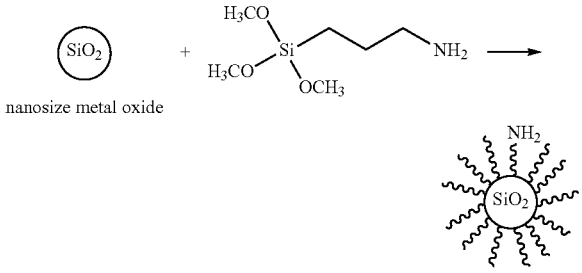

Step 3: Grafting Functionalized SiO2 Metal Oxide onto Functionalized Polyester Resin

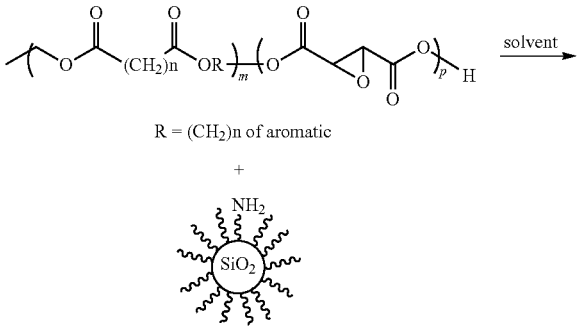

-continued

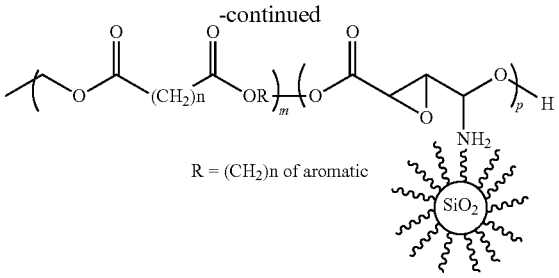

An illustrative example regarding the use of a metal oxide in a shell component in an emulsion aggregation process will now be described. In particular, a general procedure for the preparation of cyan toners comprised of 56.1 percent by weight of amorphous resin for the particle core, 12 percent by weight of the crystalline resin, 3.9 percent by weight of Pigment Blue 15:3, 28 percent by weight of the grafted silica nanoparticles onto the polyester resin as either the only shell resin or in combination with the amorphous core resin, and utilizing various amounts of aluminum sulfate as the coagulant, and varying the temperature and pH during coalescence to achieve the desired particle size and size distribution. For a theoretical particle yield of 120 grams, the following components are used. A 2 L kettle was charged with 220 grams of the amorphous polyester emulsion at 30 percent by weight of resin, 14.4 grams of the crystalline polyester resin emulsion at 25 percent by weight resin 370 grams of water, 4.7 grams of Cyan Pigment Blue 15:3 dispersion (17 percent solids available from Sun Chemicals), and 3.7 grams of DOWFAX® surfactant (47.5 percent aqueous solution). The mixture is then stirred at 100 rpm. Next, 82.5 grams of 0.3 N nitric acid solution is added until a pH of about 4.2 is achieved, followed by homogenizing at 2,000 rpm and the addition of 59.7 grams of aluminum sulfate solution. The homogenizer speed is increased to 4,200 rpm at the end of the aluminum sulfate addition. The mixture is then stirred at 200 to 300 rpm with an overhead stirrer and placed in a heating mantle. Next, the temperature is increased to 47.5° C. over a 30 minute period, during which the particles grew to about 7 microns volume average diameter. Then, 33.6 grams of the emulsified grafted silica nanoparticles covalently attached to the polyester resin at 30 percent by weight solids in solution is added to produce a 28 percent by weight shell layer surrounding the pigmented core particles. The temperature is increased to continue particle growth to the desired particle size of 8.3 microns. A solution comprised of sodium hydroxide in water (about 4 weight percent by weight of NaOH) is then added to freeze the size (prevent further growth) until the pH of the mixture was about 6.8 to 7.5. During this addition, the stirrer speed is reduced to about 150 rpm, the mixture was then heated to 63° C. over 60 minutes, after which the pH is maintained at about 6.6 to about 6.8 with drop wise addition of an aqueous solution of sodium hydroxide (4 weight percent by weight). Subsequently, the mixture is heated to coalescence at a final temperature producing a desired particle size and particle morphology as measured as circularity of about 0.960 to about 0.980 as measured by SYSMEX FPIA-2100 flow-type histogram analyzer.

The above toner has excellent external particle additive retention in paint shake test (representative of toner environment in use), and thus advantageously retains tribo charge over time, unlike conventional toner/additive combinations.

It will be appreciated that various of the above-disclosed and other features and functions, or alternatives thereof, may be desirably combined into many other different systems or applications. Also, it will be appreciated that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. Toner particles comprising a core-shell structure, wherein:

the core comprises:

at least one binder, and at least one colorant;

the shell comprises at least one metal oxide particle covalently bonded to at least one polycondensation polymer, the covalent bond being between:

an amine of the at least one metal oxide particle and an epoxide of the at least one polycondensation polymer, or an epoxide of the at least one metal oxide particle and a carboxylic acid of the at least one polycondensation polymer.

2. The toner particles according to claim 1, wherein the metal oxide particle is a nano-sized metal oxide particle ranging in size of from about 10 nm to about 500 nm.

3. The toner particles according to claim 1, wherein the at least one polycondensation polymer is a polyester.

4. The toner particles according to claim 1, wherein the at least one binder is selected from the group consisting of amorphous polyester, crystalline polyester, and mixtures thereof.

5. The toner particles according to claim 1, wherein the metal oxide particle is selected from the group consisting of silicon dioxide, titanium dioxide and mixtures thereof.

6. The toner particles according to claim 5, wherein the metal oxide particle has an average size of from about 10 nm to about 50 nm.

7. The toner particles according to claim 1, wherein the toner particles are emulsion aggregation toner particles.

8. The toner particles according to claim 1, wherein the core further comprises a wax.

9. The toner particles according to claim 1, wherein the at least one binder comprises a mixture of amorphous polyester and crystalline polyester.

10. The toner particles according to claim 9, wherein the shell is free of crystalline polyester.

11. The toner particles according to claim 1, further in admixture with carrier particles.

12. The toner particles according to claim 1, wherein the at least one metal oxide particle covalently bonded to at least one polycondensation polymer is present in an amount from 0.5% to 15% by weight of the toner particles.

13. A method of making toner particles, comprising:

aggregating an emulsion comprising a polymer binder and at least one colorant to form cores;

introducing an emulsion of shell material following formation of the cores, and continuing aggregation to form shells of the shell material on the cores; and thereafter ceasing aggregation and recovering core-shell toner particles, wherein:

the shell material comprises at least one metal oxide particle covalently bonded to at least one polycondensation polymer, the covalent bond being between:

an amine of the at least one metal oxide particle and an epoxide of the at least one polycondensation polymer, or an epoxide of the metal oxide particle and a carboxylic acid of the at least one polycondensation polymer.

14. The method of claim 13, wherein the metal oxide particle is selected from the group consisting of silicon dioxide, titanium dioxide and mixtures thereof.

15. The method of claim 13, wherein the binder of the cores comprises a mixture of an amorphous polyester and a crystalline polyester.

16. The method of claim 15, wherein the at least one polycondensation polymer of the shell material comprises an amorphous polyester.

17. Toner particles comprising a core-shell structure, wherein:

the core comprises:

at least one binder, and at least one colorant; and the shell comprises:

at least one metal oxide particle covalently bonded to at least one amorphous polyester.

* * * * *